US005090559A

United States Patent [19]

Gendreau

[11] Patent Number: 5,090,559

[45] Date of Patent: Feb. 25, 1992

[54] REUSABLE GARMENT BAGS FOR DRYCLEANING

[75] Inventor: Alan Gendreau, Elgin, Ill.

[73] Assignee: Safety Kleen Corp., Elgin, Ill.

[21] Appl. No.: 615,468

[22] Filed: Nov. 19, 1990

[51] Int. Cl.[5] ..... B65D 85/18

[52] U.S. Cl. ..... 206/278; 206/279; 206/284; 206/286; 206/287; 383/41; 383/23

[58] Field of Search ..... 206/278, 279, 284, 286, 206/287, 287.1, 292; 383/39, 40, 41, 23, 75, 117; 190/111

[56] References Cited

U.S. PATENT DOCUMENTS

| | | | |
|---|---|---|---|
| 1,895,208 | 1/1933 | Salavsky | 383/40 |
| 2,590,462 | 3/1952 | Rassenfoss | 383/23 |
| 2,815,785 | 12/1957 | Vail | 383/75 |
| 4,067,066 | 1/1978 | Bruno | 383/75 |

FOREIGN PATENT DOCUMENTS

| | | | |
|---|---|---|---|
| 475548 | 7/1951 | Canada | 383/75 |
| 1288052 | 1/1969 | Fed. Rep. of Germany | 206/287 |
| 1039181 | 5/1953 | France | 206/287 |

*Primary Examiner*—Paul T. Sewell
*Assistant Examiner*—Marie D. Patterson
*Attorney, Agent, or Firm*—Lockwood, Alex, FitzGibbon & Cummings

[57] ABSTRACT

A cleaner environment is promoted by halting the use of one-time disposable packaging materials which are destined to end up in municipal landfills already strained to capacity and by substituting reusable or recyclable materials in their stead. The present invention provides a reusable carrier bag for dry cleaning, which is convertible between a first orientation of use wherein it serves as a duffel bag like carrier for collecting and carrying dirty clothing to the dry cleaners. After the clothing is cleaned and pressed and hung on a hanger, the reusable dry cleaner bag in a second orientation of use serves as a protective covering for the cleaned items for the return trip from the cleaners to the home. In accordance with a preferred embodiment, the reusable dry cleaner bags, once assigned to a customer, are themselves dry cleaned with each customer load. The preferred dry cleaner bags also include hanger holding means for accumulating and managing empty hangers to be returned to the dry cleaner for re-use. The new and improved dry cleaner bags of the invention will substantially reduce or eliminate the solid waste problem caused by the non-biodegradable poly bags and hangers previously simply thrown away by each dry cleaning customer.

6 Claims, 2 Drawing Sheets

REUSABLE GARMENT BAGS FOR DRYCLEANING

BACKGROUND OF THE INVENTION

The present invention generally relates to changes being made in our daily lives, in our thinking and in our routines to avoid the use of one-time disposable materials and to substitute reusable or recyclable materials instead to reduce or eliminate solid waste. More particularly, it relates to a new and improved reusable garment bag for use by dry cleaning customers and establishments which serves as a sack-like carrier for clothing to be cleaned and as a sheath like protector for cleaned and ironed clothing arranged on hangers.

Public awareness of environmental crises and issues confronting our society has risen sharply in the last two decades. Recently, environmental issues have become important even at local levels in our municipalities. Smaller towns and villages now are being required to consider and adopt alternative disposal plans for lawn and yard waste and solid waste because of a critical shortage of landfill space. To help make existing landfill facilities last longer before they become completely filled up, most municipalities have adopted mandatory or voluntary recycling practices. "Earth day", citizen activist groups, scientists and a large number of television documentaries and public information and service programs have all increased public awareness of these issues.

As more information becomes available, consumers have clearly indicated their level of concern and their commitment to search for and be part of solutions to these problems. Nowadays, increasing numbers of consumers are using some form of curbside recycling and are composting their yard waste, for example. In a recent poll conducted by a national newspaper organization, sixty percent (60%) of the people polled said they were willing to pay more for goods and services for a cleaner environment. Seventy-two percent (72%) said they already employ some form of household recycling and ninety-three percent (93%) said that recycling of newspapers, bottles and cans should be mandatory. Fifty-two percent (52%) of the respondents indicated that they had already changed their buying practices by boycotting products sold by companies they thought were polluting the environment. Finally, the results of the survey indicated that although sixty-seven percent (67%) were most worried about hazardous waste, a majority of people, e.g. 54%, indicated that they now felt guilty about using products with unnecessary packaging.

Public awareness of environmental issues is also apparent from the large numbers of customers approaching their dry cleaners wanting to know if alternative plans for disposal of the plastic poly bags, other than landfill disposal, are being organized and arranged. The current practice is for the consumer to remove the poly bags from the garments and throw them in the trash. Recent best estimates are that over one billion dry cleaner bags and over one billion metal hangers are disposed of each year from drycleaned garments in municipal landfills, and the numbers may be considerably higher. This estimate represents, for example, two articles of dry cleaning for every 100 million of working americans per week, or only 100 dry cleaning bags per person per year.

Current efforts to make dry cleaning services more environmentally sound have included proposals for recycling the plastic bags. More particularly, in accordance with one recycling proposal, the consumer is responsible for collecting the plastic bags and returning them to the dry cleaner. The dry cleaner is responsible for storing the collected bags until they are transported back to the manufacturer for recycling.

This proposal has a number of disadvantages associated with it. For the consumer, the consumer must collect the bags over a given time period and then return them to the neighborhood dry cleaner. The inconvenience associated with this practice or change in practice may predictably result in only a small percentage of customers participating in the activity. For the dry cleaners, containers and space have to be provided to permit the bags to be accumulated and stored for a period of time before they are returned to the supplier. Dry cleaning plants in storefronts are most commonly the most cluttered area in town and little or no space is available for the collection bins especially in front customer service areas. Accordingly, bags collected at the front of the store may have to be moved to a rear storage container. This may tend to increase the cost of labor which is the highest cost of business for a dry cleaner. For the bag supplier, the bags must be collected from the various dry cleaning establishments and returned to the manufacturer for recycling. These extra responsibilities will add to the cost in terms of labor and transportation for the bag suppliers. Furthermore, at the present time, it is not known whether any of the poly bag manufacturers are equipped to recycle poly bags. The recycling process, if it needs to be developed, will require capital investment and time for research, equipment and labor, further adding to the costs of implementing a recycling program.

To overcome the shortcomings and disadvantages of the prior art practices and proposals, it is an object of the present invention to provide a new and improved arrangement for handling dry cleaning which substantially reduces or eliminates production of solid waste in the form of poly bags and metal hangers requiring disposal.

It is another object of the present invention to generally reduce or eliminate from our lifestyles and daily routines the use of one-time disposable packaging and materials in cyclical service arrangements in our society and to substitute reusable and recyclable products for use therein, to reduce the generation of non-biodegradable and other solid waste requiring landfill disposal.

SUMMARY OF THE INVENTION

In accordance with these and other objects, and in its broadest aspects, the present invention relates to a new and improved reusable carrier and method for using the reusable carrier in a servicing context, wherein goods or articles are used at a first location, for example, in the home and, after use, are taken out to some servicing location for servicing such as for dry cleaning, reconditioning or the like.

Broadly, the present invention relates to a cyclic arrangement of using an article including at least one reusable article which is used at a first location. In the process of being used, the article is changed from a first condition to a second condition. After use, the article is transported in its second condition and in a first configuration from the first location to a second location. At the second location, the article is serviced in some way so that the condition of the article is changed from the second condition back to the first condition. Moreover, at the second location the article is also changed with respect to configuration from its first configuration to a second, different configuration for reuse. Thereafter, in accordance with the cyclic arrangement, the serviced article in its first condition and second configuration is returned to the first location for another use.

The improvement in this arrangement, in accordance with the present invention, comprises a reusable protective carrier means for protectively transporting the article in either direction between the first and second locations. The carrier means includes a carrier body for protectively surrounding the article during transport. The carrier body is convertible between a first orientation of use and a second orientation of use. In its first orientation, the carrier is adapted to receive the article(s) in its first configuration. In its second orientation, the carrier is adapted to receive the article(s) in its second configuration. Means are also provided in the carrier to maintain the article(s) in the carrier body during transport in either direction to or from the first location, in either the first or second configuration, respectively.

In a preferred embodiment, the present invention provides a new and improved reusable dry cleaning bag comprising an elongate bag including a pair of webs joined together along peripheral edges thereof to define an open end and an opposed closed end. The webs are formed from a dry cleanable material and preferably are formed from a dry cleanable water resistant woven fabric material. A hanger hook opening is provided in the closed end of the carrier bag. Accordingly, cleaned and pressed articles of clothing on hangers may be placed inside the carrier bag for weather and stain protection so that the hanger hook portions are available from the outside of the carrier to facilitate hand-carrying or hanging on a rod, rack, hook or holder.

The open end of the bag includes a releasable closure means for selectively opening and closing the open end of the bag. Preferably, the dry cleaner bag further includes means defined on said carrier body for receivably securing associated returnable and reusable structures such as hangers, to the carrier for return to the second dry cleaner servicing location. Especially preferably, the hanger receiving and securing means for the carrier includes pocket means defined on an outer surface of the carrier bag having a recloseable opening configured to receive a plurality of wire clothes hangers. The hanger pocket is configured to receive a plurality of wire clothes hangers to permit them to be returned and reconditioned or reused.

In accordance with the contemplated improvement provided by the present invention, a neighborhood dry cleaner may implement an environmentally-sound cyclic service arrangement with each customer by providing each customer with at least one and preferably two of the reusable dry cleaning bags of this invention. One dry cleaner bag may be hung in the customers closet in its first orientation of use, e.g. open end up, to serve as a duffel bag receiver. In this orientation, the carrier is useful to collect one or more pieces of the customer's previously worn, soiled, dirty and/or wrinkled clothes, usually in a balled-up configuration, until the customer is ready to visit the drycleaner. A hanger holder means preferably in the form of a hanger-receiving pocket or a strap holder is provided on the inside or outside of the dry cleaner bag to hold and accumulate hangers to be returned to the dry cleaner. After a period of time, the customer merely closes the recloseable open end of the dry cleaner bag and takes the clothing to be cleaned to the drycleaner.

In accordance with the improved arrangement, the dry cleaner takes the dry cleaner bag, removes any returned hangers for recycling or reuse and processes the customer's order in accordance with their usual procedures. However, the dry cleaner bag is checked in with the customers clothes and the dry cleaner bag itself is also dry cleaned as well as the customer's clothing with each order. The garment bag remains with the customers clothing so that when the customers clothing for that order has been dry cleaned, pressed and hung on hangers, the dry cleaner bag may be used for its other purpose in its second orientation of use. More particularly, in its second orientation of use, the dry cleaner bag of this invention is oriented in a closed end up position and the carrier is slipped down over the clothes to provide a protective carrier for the cleaned hanging clothing. On return home, the customer may remove the cleaned clothes from the carrier bag, and invert the carrier to its duffel bag first orientation of use to repeat the clean and wear cycle.

In accordance with the invention, the reusable dry cleaner bags may be made so that they last for several years. The use of the dry cleaner bags of the invention is expected to dramatically reduce or eliminate the need for the non-biodegradable poly bags previously used by the dry cleaning industry. A significant impact in reducing the generation of solid waste materials destined for landfill disposal is expected to be provided.

Other objects and advantages of the present invention will become apparent from the following Detailed Description of the Invention taken in conjunction with the Drawings, in which:

DETAILED DESCRIPTION OF THE PREFERRED EMBODIMENTS

Figure 1:
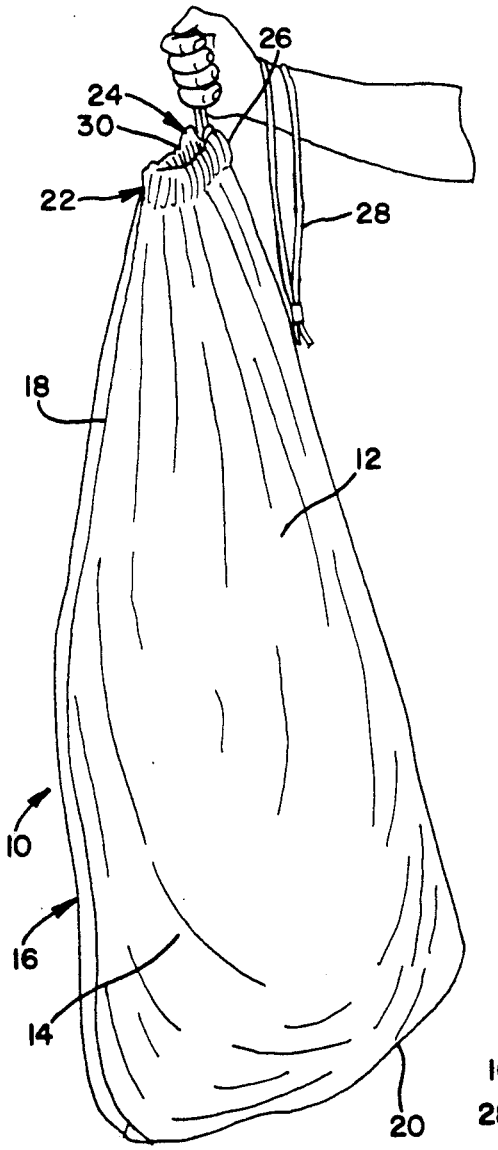
FIG. 1 is a perspective view of the new and improved reusable dry cleaner bag of the present invention shown in a first orientation of use.
Figure 2:
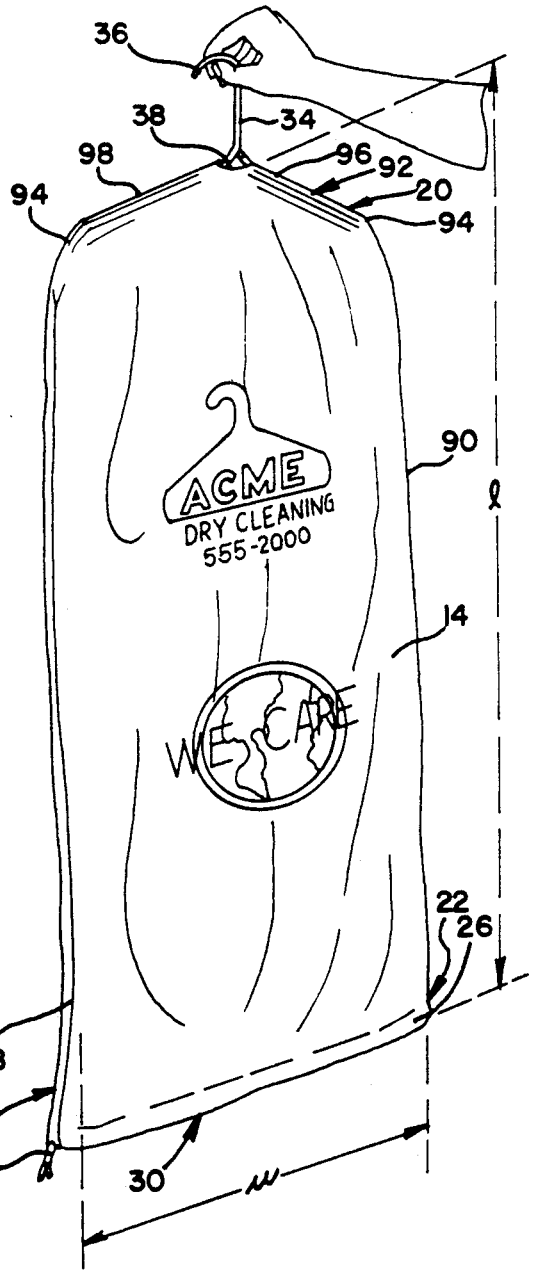
FIG. 2 is a perspective view of the new and improved dry cleaner bag of this invention shown in a second orientation of use.

Referring now to FIGS. 1–2, a preferred carrier in the form of a reusable dry cleaner carrier bag, generally referred to by reference numeral 10, is shown. Dry cleaner bag 10 includes a bag carrier body 12 defined by a pair of flexible woven fabric web portions 14 and 16. Webs 14 and 16 are preferably made of a durable dry cleanable woven fabric material which is or may be treated to be water resistant, water repellent or water proof. Webs 14 and 16 are joined together adjacent their respective edges, preferably by being sewn or stitched together to define seams 18 thereby defining a bag carrier body 12 having a closed end portion 20 and an opposed open end portion 22.

As shown in FIG. 1, open end portion 22 is provided with a releasable closure means. In accordance with the preferred embodiment depicted in FIG. 1, the releasable closure is a cinchable draw string closure 24 including a continuous folded over peripheral hem portion 26 and a draw string 28. Pulling on the draw string 28 is effective to close down or narrow the opening 30 in open end 22 in a well known manner.

New and improved carrier bag 10 is shown in a first orientation for use in FIG. 1 wherein the open end 22 is up so that the bag is positioned to receive dirty clothes through the top opening 30 in a duffel bag fashion. The top opening 30 may be widened by engaging opposed sides of the top opening 30 and pushing outwardly to enable clothing to be placed in the interior cavity 32 defined by the bag 10.

Referring now to FIG. 2, carrier bag 10 is shown in use surroundingly protecting dry cleaned and pressed clothing articles which have been hung on a hanger 34. The curved hook portion 36 extends through a small hanger opening 38 provided at a central location along closed end portion 20. In the preferred embodiment shown in FIG. 2, carrier body 12 in its second closed end up orientation includes a lower elongate flat tubular portion 90 of relatively constant width, w, and an upper or top transition portion 92 of triangular configuration with a gradually narrowing width dimension effectively defining a shoulder at 94 on each side of carrier body 12. The tapered transition portion 92 generally follows the contour of most clothes hangers 34. Closed end 20 has tapering sides 96 and 98 extending between shoulder sections 94 and hanger hook opening 38. The carrier body is also preferably provided with a length dimension, l, which is of sufficient length to extend beyond overcoats dresses or other frequently cleaned longer length garments. Generally, carrier body 12 should be provided with a width dimension, w of between about 20–40 inches and a length dimension l, of between about 45 to 90 inches; an especially preferred generic and useful carrier bag 10 may have a width of about 36 inches and a length of about 55 to 65 inches.

Figure 3:
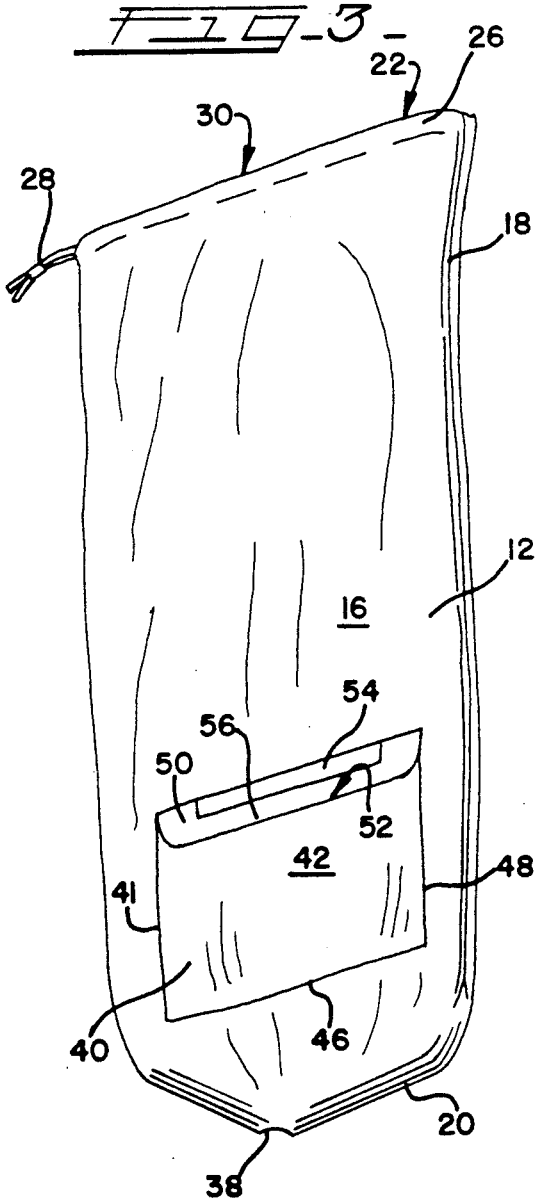
FIG. 3 is a perspective view of the new and improved dry cleaner bag in an open first orientation of use and including an outer hanger receiving pocket in accordance with the preferred embodiment of the present invention.

Referring now to FIG. 3, the preferred dry cleaner bag 10 also includes means for receiving and securing a number of used hangers to be returned to the dry cleaner for re-use in the form of a hanger receiving pocket 40. Pocket 40 includes a generally rectangular piece of fabric 42 secured along three of its peripheral edges 44, 46 and 48 to web 16 of carrier body 12. Pocket 40 includes an open side 50 provided with a recloseable fastener such as a hook and loop fastener strips 52 and 54 indicated at open side 50. Pocket 40 defines a hanger-receiving space or recess 56. Preferably, the open side 50 of pocket 40 is defined so that it extends generally parallel to the open end 22 and preferably is disposed adjacent closed end 20. By placing the pocket 40 in this manner, hangers may readily be placed in pocket 40, even when carrier bag 10 is suspended from the open end 22 with opening 30 in its drawn and closed position.

Figure 4:
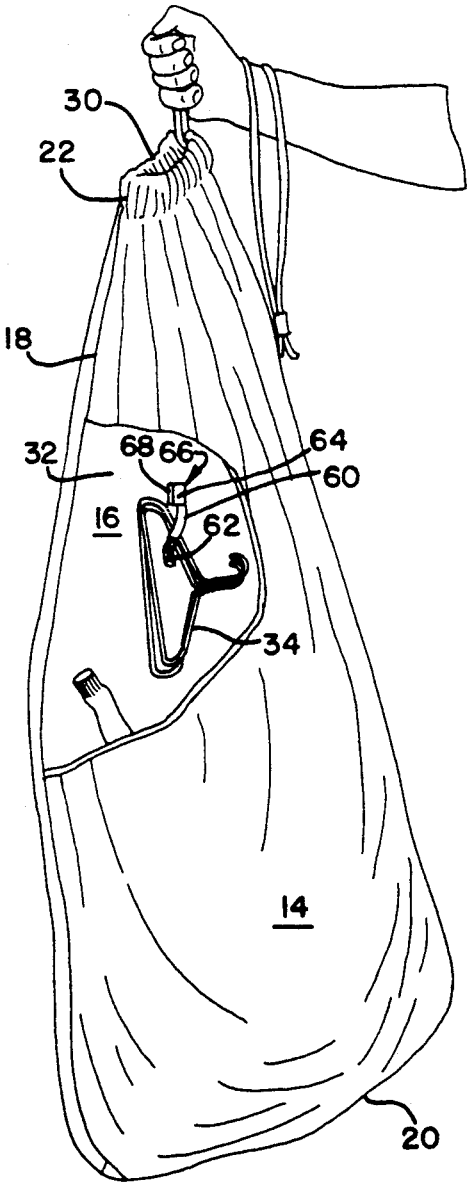
FIG. 4 is a perspective view of the new and improved dry cleaner bag in accordance with the invention having portions partially cut away to reveal a hanger-engaging strap arrangement in accordance with an alternate embodiment of the invention.

Referring now to FIG. 4, an alternate arrangement for managing hangers to be returned may be provided in the form of an elongate strip 60. Hanger holding strip 60 includes a first end 62 secured to an inner surface of web panel 16 and an opposed free end 64 having a hook and loop fastener element 66 engagable with a complimentary hoop and loop fastener patch 68 also provided on the inner surface of web panel 16. The strip 60 may be threaded through a hanger 34 as shown. The hanger strip 60 may also be attached to the outside surface of carrier bag 10.

Dry cleaner bag 10 is intended to be reused many times and is generally made to last for several years, preferably 2–5 years, especially preferably for at least 3 years. The web portions 14 and 16 are accordingly made of a high strength, tough, durable material capable of being dry cleaned repeatedly. Illustrative materials for use herein as webs 14 and 16 are woven and non-woven fabrics made from thermoplastic fibers. Examples may include polyester, nylon, polyaramid, polyvinyl chloride, polypropylene and polyethylene fibers and fabrics. Especially preferred for their toughness, durability and resistance to dry cleaning solvents are polyesters and polyamides such as nylons and aromatic polyamides such as KEVLAR® (DuPont).

Each of the sewn or stitched seams are preferably sewn with resilient flexible thermoplastic thread also exhibiting resistance to repeated exposure to drycleaning solvents, such as polyester threads. Each of the sewn seam portions 18 are stitched with high quality, high strength stitching and double seams and reinforced box seams and bar tacked edges and the like may be provided to extend the useful life of dry cleaner bag 10. Potential points of wearing, such as around hanger opening 38 and at points where draw string 28 enters and exits peripheral hem portion 26 are preferably reinforced by means of extra stitching, additional fabric or by providing metal eyelet reinforcements adjacent the draw string opening, respectively.

In accordance with the present invention, the new and improved dry cleaner bag 10 is specially proportioned and configured to receive clothing articles and may be provided in width and length combinations suitable to receive suits, dresses, overcoats and the like. As shown in FIG. 2, the opposed major outwardly facing surfaces of the carrier body 12 on web portions 14 and 18 may be provided with written letters, symbols or other indicia, applied in the form of drycleaning solvent indelible inks or paints to identify the cleaning service by name, address and phone number and to advertise their concern for promoting a safer environment.

New and improved dry cleaner bag 10 is convertible from a sack-like, open top orientation of use such as shown in FIGS. 1 and 3–4 to a sheath like protective second orientation of use as shown in FIG. 2. It is capable of protectively surrounding clothes whether they are in a rumpled, balled up configuration or in a hangingly suspended neatly pressed configuration, whether they are in a dirty condition or a cleaned condition.

The new and improved dry cleaner bags are intended to be dry cleaned on a regular basis in accordance with the preferred cycle of use, so that no unpleasant odors or other undesirable condition should arise with their repeated use. Adoption and use of the dry cleaner bags should promote a cleaner environment by dramatically reducing disposable waste previously associated with polybags and hangers.

Although the present invention has been described with reference to certain preferred embodiments, modifications or changes may be made therein by those skilled in this art. For example, instead of using a pair of woven fabric webs to form the carrier bag body, a single doubled over web may be used. Instead of providing a cinchable purse string closure as the open end releasable closure means, other well known releasable closures, such as zippers, snaps, hook and loop fasteners or buttons might be used. Moreover, instead of stitching woven fabrics to form the bag body and top hem, other securement methods including riveting, adhesive bonding or thermal fusion bonding or welding methods may also be used. The hanger pockets and/or strips may be placed on the interior or the exterior of the carrier bag as desired or required. The outer surface of the dry cleaner bags may be screened or otherwise painted or printed with drycleaning solvent-indelible inks or paints to provide various indicia and messages on the outside thereof. All such obvious modifications may be made herein by those skilled in this are without departing from the scope and spirit of this invention as defined by the appended claims.

I claim:

1. A reusable dry cleaning garment bag comprising:

an elongate bag body defined by a pair of web portions joined together along respective peripheral edges thereof, said bag body including an open end having releasable closure means including a cinchable drawstring slidably enclosed in a peripheral hem provided in said open end and having a permanently closed end having a small hanger hook opening, said garment bag further including hanger holder means on said bag body for receiving, storing and accumulating a plurality of hangers to be returned to the dry cleaner for reuse, said hanger holder means including a hanger receiving pocket defined on said bag body configured to receive a plurality of empty hangers to be returned, said hanger receiving pocket having a pocket opening with releasable closure means, said garment bag being useful in an open-end-up orientation to receive and carry clothing articles to be dry cleaned and being useful in a closed-end-up orientation to surroundingly protectively receive returning cleaned clothing articles arranged on hangers with a hook end of each hanger being received through said hanger hook opening.

2. A reusable dry cleaner bag as defined in claim 1 wherein said hanger receiving pocket is provided on the exterior of the bag body.

3. A reusable dry cleaner bag as defined in claim 1, wherein said hanger receiving pocket is provided on the inside of the bag body.

4. A reusable dry cleaner bag as defined in claim 1, wherein said pocket is disposed adjacent the closed end of said bag body and said reclosable pocket opening extends generally parallel to the open end of said bag body.

5. A reusable dry cleaner bag as defined in claim 1, wherein said releasable closure means in said pocket opening includes cooperating aligned hook and loop fastener portions.

6. A reusable dry cleaning garment bag comprising:

an elongate bag body defined by a pair of web portions joined together along respective peripheral edges thereof, said bag body including an open end having a peripheral hem and a cinchable draw string slidably disposed in said peripheral hem for selectively closing the open end and an opposed permanently closed end having a small hanger hook opening and further including hanger holder means in said bag body for receiving, storing and accumulating a plurality of hangers to be returned to the dry cleaner for reuse, said garment bag being useful in an open-end-up orientation to receive and carry clothing articles to be dry cleaned and being useful in a closed-end-up orientation to surroundingly protectively receive returning cleaned clothing articles arranged on hangers with a hook end of each hanger being received through said hanger hook opening.

* * * * *